US006820621B2

(12) United States Patent
DeMayo

(10) Patent No.: US 6,820,621 B2
(45) Date of Patent: Nov. 23, 2004

(54) LATERAL SURGICAL POSITIONER UNIT

(75) Inventor: Edward DeMayo, Greenbrae, CA (US)

(73) Assignee: IMP Inc., Plainville, CT (US)

( * ) Notice: Subject to any disclaimer, the term of this patent is extended or adjusted under 35 U.S.C. 154(b) by 421 days.

(21) Appl. No.: 10/103,091

(22) Filed: Mar. 22, 2002

(65) Prior Publication Data

US 2003/0178027 A1 Sep. 25, 2003

(51) Int. Cl.[7] ..... A61G 15/00

(52) U.S. Cl. ..... 128/845; 128/846; 128/869; 128/870; 5/621

(58) Field of Search ..... 128/845, 846, 128/869, 870, 882; 5/600, 621, 624, 630, 632, 648

(56) References Cited

U.S. PATENT DOCUMENTS 2,535,559 A * 12/1950 Wolf ..... 5/630
2,764,150 A * 9/1956 Ettinger ..... 5/630
3,042,025 A * 7/1962 Jackson ..... 5/632
3,844,550 A * 10/1974 McGuire ..... 5/621
4,866,796 A * 9/1989 Robinson et al. ..... 128/845
5,040,546 A * 8/1991 Deluhery ..... 128/870
5,390,383 A * 2/1995 Carn ..... 5/624
5,575,027 A * 11/1996 Mueller ..... 5/621
6,003,176 A * 12/1999 Wasley et al. ..... 5/624

* cited by examiner

*Primary Examiner*—Fadi H. Dahbour

(57) ABSTRACT

A patient's hip surgery support plate in the form of a posterior sacral support unit is locked to an operating table support frame. A separate anterior pelvic support unit is then positioned over the patient and joined to the sacral support unit via a post extending from the top of the sacral support unit. Both units are movably adjustable in the vertical and horizontal plane to accommodate a wide range of patient sizes for surgery where lateral decubitus positioning of the patient is required.

15 Claims, 3 Drawing Sheets

LATERAL SURGICAL POSITIONER UNIT

BACKGROUND OF THE INVENTION

Medical apparatus for securing a patient in the lateral decubitus position during surgery of the hip, or where a patient is required to lay sideways, are currently available. U.S. Pat. No. 3,844,550 entitled "Pelvic Support for Surgical Operations" describes one such support that is secured to an operating table or the like. The support includes a pair of anterior and posterior support braces for supporting a patient securely in the lateral decubitus or side position for surgeries of the hip. The anterior and posterior support braces are mounted on a support plate that allows the movement of the braces in the horizontal and vertical plane to compensate for the size and structure of the specific patient.

In surgical procedures such as hip arthroplasty and hip fracture, it is sometimes necessary to flex the hip beyond 90 degrees to check range of motion and stability of the hip joint. In a dislocation of the hip it is also necessary to flex the hip beyond 90 degrees. The unidirectional movement of the support plate described within the aforementioned U.S. Pat. No. 3,844,550 does not readily allow flexion of the hip beyond a limited angle of 90 degrees.

U.S. Pat. No. 6,003,176 entitled "Universal Lateral Positioner" describes a more recent arrangement for providing a greater range of positional support for a patient during hip surgery. This positioner requires additional pads and extensions to accommodate hip surgery on obese patients It would be desirable to utilize such a support plate for hip surgery and adapt the support plate for extended flexion of the hip when large dimensional adjustments are required.

Accordingly, one purpose of the invention is to describe a hip surgery positioner unit that allows sufficient dimensional adjustment range to accommodate patients over a wide range of physical sizes and weights without requiring additional support equipment that could provide unnecessary pressure on the patient's lower abdomen.

SUMMARY OF THE INVENTION

A patient's hip surgery support system includes a posterior sacral support unit, which is locked to the operating table support frame. A separate anterior pelvic support unit is then positioned over the patient and joined to the sacral support unit via a post extending from the top of the sacral support unit. The sacral support unit is in the form of a bottom plate movably adjustable on the support frame that includes a pair of vertical plates. One vertical plate serves to support the sacrum while the other plate allows positional rotation in the vertical plane at the superior iliac crest. The anterior pelvic support unit connects with the sacral connecting post via a rotatable sleeve having a downwardly extending rotary arm and a sliding extension arm. The anterior pelvic support plate connects with the rotary arm via a height adjustment sleeve for controlled adjustment in the vertical plane and with the upright post of the sacral support via a lateral compressing arm.

DESCRIPTION OF THE PREFERRED EMBODIMENT

Figure 1:
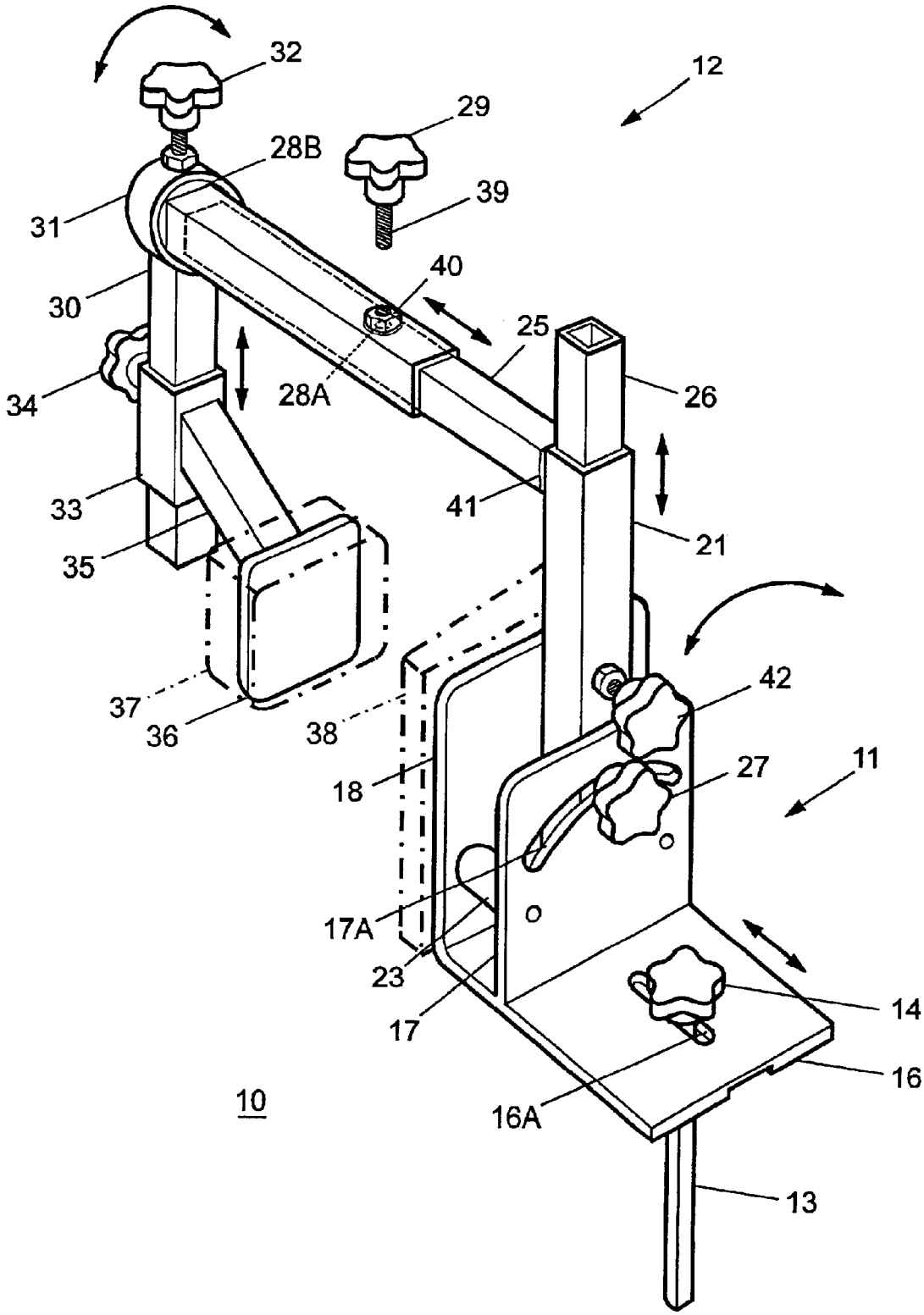
FIG. 1 is a top perspective view of the hip positioner unit according to the invention.

The two-part surgical hip support 10 according to the invention is shown in FIG. 1 to comprise an adjustable posterior sacrum support 11 joined to an adjustable anterior pelvic support 12 by means of a lateral extension arm 25. The sacrum support is attached to an operating table side rail (not shown) by means of the downwardly extending side rail locking support bar 13. The sacrum support includes a bottom plate 16, which slidably attaches to the support bar by means of the extended slot 16A and associated knob 14, which allows adjustment of the sacrum support in the horizontal indicated direction. A rotatable adjustment plate 17 extends upwards from the bottom plate 16 and includes a radial slot 17A for rotatable adjustment of the lateral extension arm 25, connecting with the upright central post 26 in the sacrum support, in the vertical indicated direction by means of the associated knob 27. A vertical sacrum support plate 18, attached to the adjustment plate 17 by means of the spacer tubes 23, extends from the end of the bottom plate 16 for contact with the posterior of the patient as described below in greater detail. A central post 26 is secured to the bottom plate 16 to receive the posterior height adjustment sleeve 21, which is positioned perpendicular to the extension arm 25 and secured to the extension arm, as indicated at 41, which thereby allows the adjustment of the anterior pelvic support 12 in the horizontal indicated plane by operation of the knob 29.

The knobs 27, 32, 34, 42 herein operate in the manner described for knob 29, as follows. A threaded bolt 39 extends from the bottom of the knob 29 and engages within the nut 40, which is welded to the extension sleeve 28 as indicated at 28A, into abutment with the extension arm 25, whereby tightening of the knob 29 retains the positional relationship of the anterior pelvic support 12 relative to the sacrum support 11. The extension sleeve 28 terminates in a circular end configuration, as depicted at 28B, which end is received within the circular sleeve 31 attached to the end of the rotary arm 30 to thereby allow rotation of the rotary arm 30 in the vertical plane as indicated, upon operation of the knob 32. The anterior pelvic support plate 36, attached to one end of the lateral support arm 35, opposite the sacral support plate 18 for receiving a patient in the manner to be discussed below, in greater detail. The lateral support arm 35 terminates in a vertical height adjustment sleeve 33 arranged on the rotary arm 30 for vertical displacement of the anterior pelvic support plate, upon operation of the knob 34. As indicated in phantom, sterile pads 37, 38 are attached to the anterior pelvic and posterior sacral support plates 36, 18 to comply with the requirements of the sterile operating field.

Figure 2:
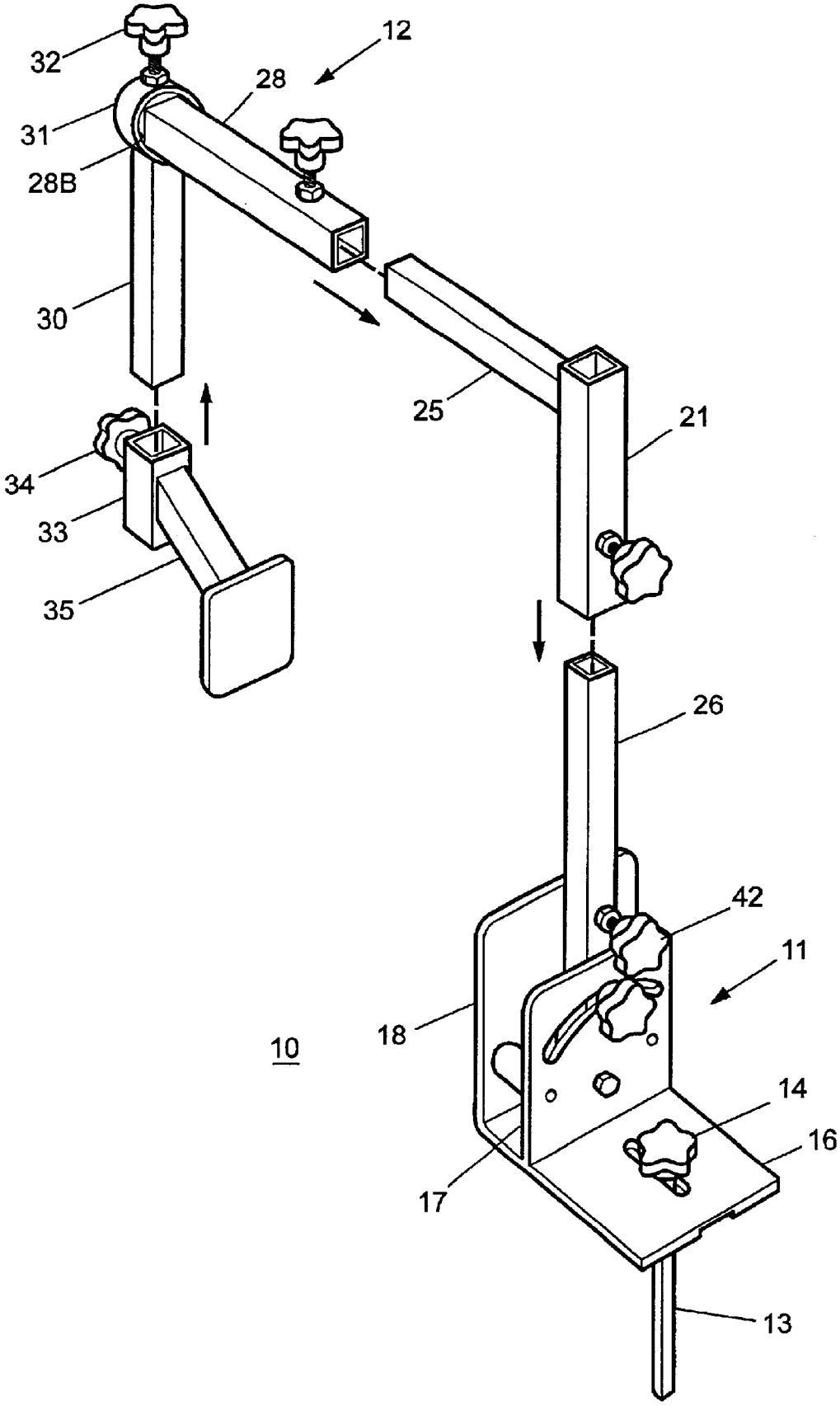
FIG. 2 is a top perspective view of hip positioner unit of FIG. 1 with the associated components in isometric projection.

The assembly of the pelvic support 12, prior to attaching to the sacral support 11, is best seen by referring now to FIG. 2 The lateral support arm 35 is attached to the rotary arm 30 by positioning the adjustment sleeve 33 at the end of the support arm 35 over one end of the rotary arm 30 and tightening the adjustment knob 34 on the extension sleeve 33. The rotating sleeve 31 at the end of the rotary arm 30 is positioned over the circular end 28B of the extension sleeve 28 and is held in position by tightening the adjustment knob 32 to complete the pelvic support 12.

The sacral support 11 is positioned on the operating table side rail (not shown) by means of the side rail locking bar 13 in the manner described, for example, in the aforementioned U.S. Pat. No. 6,003,176 such that the bottom plate 16 is adjustable via the adjustment knob 14 to move the sacral support plate 18 in the horizontal plane. The height adjustment sleeve 21, attached to the extension arm 25 is then positioned over the central post 26 extending upwards from the bottom plate 16 of the sacral support 11 and the adjustment knob 42 is tightened to complete the hip support 10.

Figure 3:
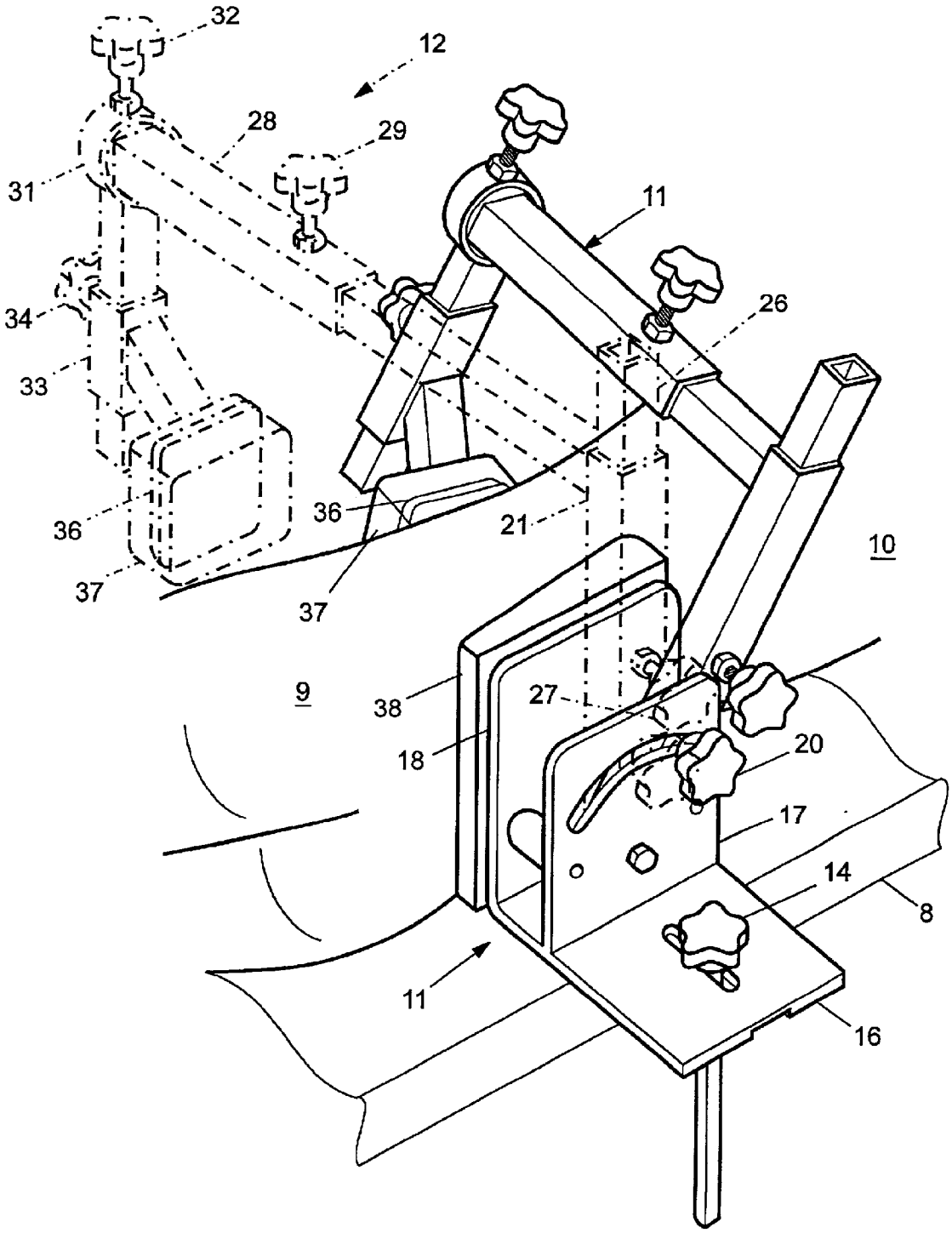
FIG. 3 is a top perspective view of the hip positoner unit of FIG. 2 supporting a patient prior to a hip surgery operation.

The hip support 10 is shown in phantom in FIG. 3 prior to positioning against a patient 9 lying in a lateral decubitus position upon the operating table 8 and in solid lines after adjustment and positioning. The sacral support 11 is first positioned on the bed frame and the vertical portion of sacral support plate 18, carrying the sterile pad 38, is moved against the sacrum of the patient by means of the adjustment knob 14 and bottom plate 16 in the manner described earlier.

The anterior pelvic support 12 is next positioned over the patient 9 and connected to the sacral support 11 via adjustment sleeve 21 and the support post 26 in the manner described earlier. The anterior pelvic support plate 36 carrying the sterile pad 37 is moved against the superior iliac crest of the patient 9 by means of the adjustment knobs 27, 29, 32, 34 adjustment sleeve 33, circular sleeve 31 and extension sleeve 28, as also described earlier.

A body positioning arrangement for hip treatment and surgeries in the lateral decubitus position has herein been described as including an anterior pelvic support and posterior sacral support providing a wide variation of movement in the horizontal and vertical planes, with a minimum number of essential components

What is claimed is:

1. A support system for positioning a patient undergoing hip replacement and hip surgery comprising:

a sacral support unit arranged for attachment to an operating table side rail, said sacral support unit comprising a bottom plate having an upstanding adjustment plate spaced apart from an upstanding sacral support plate and a support post positioned on said bottom plate; and a pelvic support unit, said pelvic support unit comprising an extension arm terminating at a height adjustment sleeve at one end and receiving a horizontal adjustment sleeve at an opposite end thereon, said horizontal adjustment sleeve adapted for receiving a rotary arm, said rotary arm being adapted for supporting a pelvic support plate thereon.

2. The support system of claim 1 wherein said bottom plate includes means for translation thereof in a horizontal plane.

3. The support system of claim 2 wherein said bottom plate means for translation comprises a bottom plate adjustment knob within a bottom plate slot.

4. The support system of claim 1 wherein said adjustment plate includes means for translation thereof in a vertical plane, perpendicular to said vertical plane.

5. The support system of claim 4 wherein said adjustment plate means for translation comprises an adjustment plate adjustment knob within an adjustment plate radial slot.

6. The support system of claim 1 wherein said height adjustment sleeve is movably arranged on said support post for joining said pelvic support unit to said sacral support unit.

7. The support system of claim 1 wherein said pelvic support plate is attached to a pelvic plate support arm and said pelvic plate support arm terminates in a pelvic plate support arm sleeve.

8. The support system of claim 5 wherein said pelvic plate support arm sleeve is movably attached to said rotary arm.

9. The support system of claim 1 wherein said horizontal adjustment sleeve terminates in a circular end configuration for receiving a circular sleeve formed on one end of said rotary arm.

10. The support system of claim 1 including a sterile sacral pad on said sacral support plate.

11. The support system of claim 1 including a pelvic pad on said pelvic support plate.

12. A method for preparing a patient for hip surgery comprising the steps of: providing a sacral support unit comprising a bottom plate having an upstanding adjustment plate spaced apart from an upstanding sacral support plate and a support post positioned on said bottom plate and attaching said sacral support unit to an operating table support on one side of a patient arranged on an operating table; and providing a pelvic support unit comprising an extension arm terminating at a height adjustment sleeve at one end and receiving a horizontal adjustment sleeve at an opposite end thereon, said horizontal adjustment sleeve adapted for receiving a rotary arm, and arranging said pelvic support unit on an opposite side of said patient.

13. The method of claim 12 including the step of arranging said pelvic support unit height adjustment sleeve on said sacral support unit support post over said patient to connect said pelvic support unit with said sacral support unit.

14. The method of claim 13 including the step of moving said sacral support plate into abutment with a posterior of said patient.

15. The method of claim 13 including the step of moving a pelvic support plate into abutment with an anterior of said patient.

* * * * *